US006860344B2

(12) United States Patent
Bise et al.

(10) Patent No.: US 6,860,344 B2
(45) Date of Patent: Mar. 1, 2005

(54) MONOLITHIC ROOF CUTTING BIT INSERT

(75) Inventors: Douglas E. Bise, Chilhowie, VA (US); Phillip W. Haga, Cilhowie, VA (US)

(73) Assignee: Kennametal Inc., Latrobe, PA (US)

( * ) Notice: Subject to any disclaimer, the term of this patent is extended or adjusted under 35 U.S.C. 154(b) by 94 days.

(21) Appl. No.: 09/888,464

(22) Filed: Jun. 25, 2001

(65) Prior Publication Data

US 2002/0195279 A1 Dec. 26, 2002

(51) Int. Cl.[7] ..... E21B 10/42; E21B 10/58
(52) U.S. Cl. ..... 175/430; 175/391; 175/431
(58) Field of Search ..... 175/426, 427, 175/428, 430, 431, 391, 392

(56) References Cited

U.S. PATENT DOCUMENTS

| | | | | |
|---|---|---|---|---|
| 2,002,388 A | | 5/1935 | Bannister | |
| 2,032,328 A | * | 2/1936 | Reedy | 175/390 |
| 2,578,593 A | | 12/1951 | Phipps | |
| 2,607,562 A | * | 8/1952 | Phipps | 175/391 |
| 2,648,524 A | * | 8/1953 | Dionisotti | 175/320 |
| 2,733,943 A | | 2/1956 | Nater | 287/125 |
| 2,735,656 A | | 2/1956 | Hoglund et al. | |
| 2,802,642 A | | 8/1957 | Feucht | 255/64 |
| 2,855,181 A | * | 10/1958 | Olsen | 175/391 |
| 2,894,726 A | * | 7/1959 | Weaver et al. | 175/391 |
| 2,950,903 A | * | 8/1960 | White | 175/391 |
| 3,131,779 A | | 5/1964 | Rowley et al. | |
| 3,132,708 A | * | 5/1964 | Stockard, Jr. | 175/412 |
| 3,140,749 A | | 7/1964 | Dionisotti | 175/410 |
| 3,592,276 A | | 7/1971 | Pyles | 175/410 |
| 3,595,327 A | | 7/1971 | Self | 175/410 |
| 3,613,807 A | * | 10/1971 | Gails | 175/209 |
| 4,098,363 A | * | 7/1978 | Rohde et al. | 175/391 |
| 4,116,289 A | * | 9/1978 | Feenstra | 175/391 |
| 4,143,920 A | | 3/1979 | Haddock | 299/79 |
| 4,189,013 A | | 2/1980 | Adams et al. | 175/320 |
| 4,206,821 A | | 6/1980 | Emmerich | 175/321 |
| 4,216,832 A | | 8/1980 | Stephenson et al. | 172/540 |

(List continued on next page.)

FOREIGN PATENT DOCUMENTS

| | | |
|---|---|---|
| DE | 3025890 | 1/1982 |
| DE | 3317441 | 3/1993 |
| EP | 0941794 | 9/1999 |
| FR | 2543212 | 9/1984 |
| FR | 2779366 | 12/1999 |
| GB | 2123523 | 2/1984 |
| WO | 8502442 | 6/1985 |

OTHER PUBLICATIONS

Sitler, Manufactured Diamond and Enhanced Mining Tool Performance, Presentation No. 85–58 at SME–SIME Annual Meeting (Feb. 24–28, 1985) New York, New York.
Wimet Mining Brochure, date unknown.
Carboloy Catalog No. MT7–241 cover page and p. 16, date unknown.
PCT Search Report issued in PCT/US01/02789, filed Jan. 26, 2001, mailed Apr. 17, 2001.
Kennametal Mining Products Catalog, (1992) Kennametal Inc. pp. 18–19.

(List continued on next page.)

*Primary Examiner*—David Bagnell
*Assistant Examiner*—Jennifer H Gay
(74) *Attorney, Agent, or Firm*—Matthew W. Smith

(57) ABSTRACT

A rotary drill bit for penetrating earth strata wherein the drill bit includes a drill bit body that has an axial forward end. The drill bit body has a hard insert, which is preferably monolithic, that is affixed to the drill bit body at the axial forward end thereof. The hard insert presents at least three discrete leading cutting edges for cutting the earth strata. Each cutting edge is stepped.

9 Claims, 4 Drawing Sheets

U.S. PATENT DOCUMENTS

| | | | | |
|---|---|---|---|---|
| 4,330,044 | A | 5/1982 | Orr et al. | 175/410 |
| 4,352,400 | A | 10/1982 | Grappendorf et al. | 175/330 |
| 4,446,936 | A | 5/1984 | Sarin et al. | 175/410 |
| 4,488,609 | A | 12/1984 | Sarin | 175/410 |
| 4,492,278 | A | 1/1985 | Leighton | 175/410 |
| 4,497,520 | A | 2/1985 | Ojanen | 299/86 |
| 4,511,006 | A | 4/1985 | Grainger | 175/57 |
| 4,527,931 | A | 7/1985 | Sarin | 407/113 |
| 4,550,791 | A | 11/1985 | Isakov | 175/410 |
| 4,605,079 | A | 8/1986 | Leibee et al. | 175/410 |
| 4,725,099 | A | 2/1988 | Penkunas et al. | 299/86 |
| 4,787,464 | A | 11/1988 | Ojanen | 175/57 |
| 4,819,748 | A | 4/1989 | Truscott | 175/410 |
| 4,838,366 | A | 6/1989 | Jones | 175/410 |
| 5,172,775 | A | 12/1992 | Sheirer et al. | 175/57 |
| 5,180,022 | A | 1/1993 | Brady | 175/430 |
| 5,184,689 | A | 2/1993 | Sheirer et al. | 175/420.1 |
| 5,220,967 | A | 6/1993 | Monyak | 175/420.1 |
| 5,269,387 | A | 12/1993 | Nance | 175/420.1 |
| 5,287,937 | A | 2/1994 | Sollami et al. | 175/427 |
| 5,303,787 | A | 4/1994 | Brady | 175/430 |
| 5,375,672 | A | 12/1994 | Peay et al. | 175/420.1 |
| 5,400,861 | A | 3/1995 | Sheirer | 175/427 |
| 5,429,199 | A | 7/1995 | Sheirer et al. | 175/321 |
| 5,458,210 | A | 10/1995 | Sollami | 175/420.1 |
| 5,467,837 | A | 11/1995 | Miller et al. | 175/420.1 |
| 5,551,811 | A | 9/1996 | Satran et al. | 407/40 |
| 5,829,540 | A | 11/1998 | Peay et al. | 175/420.1 |
| 5,992,546 | A * | 11/1999 | Heinrich et al. | 175/374 |
| 6,065,908 | A | 5/2000 | Kleine et al. | 408/67 |
| 6,089,337 | A | 7/2000 | Kleine et al. | 175/394 |
| 6,145,606 | A * | 11/2000 | Haga | 175/420.1 |
| 6,595,305 | B1 * | 7/2003 | Dunn et al. | 175/420.1 |
| 2001/0013429 | A1 * | 8/2001 | Hauptmann et al | 175/395 |
| 2001/0013430 | A1 * | 8/2001 | Hauptmann et al. | 175/415 |
| 2001/0013431 | A1 * | 8/2001 | Huber et al. | 175/420.1 |

OTHER PUBLICATIONS

Kennametal Brochure "Underground . . . ", B00–28, 2000, Kennametal Inc.

Kennametal Brochure "The Mining Tool Authority"B00–27, 2000, Kennametal Inc.

Kennametal Advertisement, "Your Best Bets" Mine Expo Show Directory, 2000, Kennametal Inc., (3 pages).

Kennametal Advertisement "Underground Mining Innovations", B00–9, 2000, Kennametal Inc. (2 pages).

PCT Search Report mailed Sep. 23, 2002, in corresponding application PCT/US02/18345, filed Jun. 11, 2002.

* cited by examiner

MONOLITHIC ROOF CUTTING BIT INSERT

RELATED APPLICATIONS

This application is related to copending U.S. patent application Ser. No. 09/591,644, filed Jun. 9, 2000, to Curnie A. Dunn et al. (Case No. K-1554P), entitled "DRILL BIT, HARD MEMBER AND BIT BODY" and patent application Ser. No. 09/500,813, filed Feb. 15, 2000, by Dunn et al.

FIELD OF THE INVENTION

The invention pertains to an earth penetrating rotary drill bit that has a hard member at the axial forward end of a bit body.

BACKGROUND OF THE INVENTION

The expansion of an underground coal mine requires digging a tunnel that initially has an unsupported roof. To provide support for the roof, a rotary drill bit (e.g., a roof drill bit) is used to drill boreholes, which can extend from between about two feet to about (or even greater than) twenty feet, into the earth strata. Roof bolts are affixed within the boreholes and a roof support (e.g., a roof panel) is then attached to the roof bolts. Examples of a conventional roof drill bit with an axial forward slot that carries a blade style hard insert are shown in U.S. Pat. No. 5,172,775 to Sheirer et al.

It is desirable to provide a roof drill bit that permits completion of the drilling operation as soon as possible. A roof drill bit that presents at least three leading cutting edges increases the penetration rate due to an increase in the number of the leading cutting edges. Three leading cutting edges, especially with a radial orientation, permits the roof drill bit to advance forward with very little the roof drill bit to advance forward with very little wobble (i.e., side-to-side movement) so as to achieve balanced drilling. Leading cutting edges that terminate short (i.e., at a point radially outward) of the center point of the hard insert define a central open area so as to reduce the amount of low velocity cutting, i.e., the cutting action that occurs nearer to the center point. An increase in the number of the leading cutting edges, the balanced drilling, and the reduction in low velocity drilling each contributes to an increase in the penetration rate of the roof drill bit, which provides for the efficient completion of the drilling operation.

Clogging and stalling may occur when drilling at a higher penetration rate. It would be an advantage to adequately handle and evacuate debris so as to reduce the potential for clogging. A roof bit drill that pulverize earth strata at the tip of the bit into manageable small sized particles that can be easily evacuated. It would be an advantage to provide a roof drill bit with a drill bit body that can withstand the stresses inherent during stalling.

SUMMARY OF THE INVENTION

In one form thereof, the invention is a rotary drill bit for penetrating the earth strata. The drill bit includes a bit body that has an axial forward end wherein a hard insert, which preferably is monolithic, is affixed to the axial forward end thereof. The hard insert presents at least three leading cutting edges.

In yet another form thereof, the invention is a hard member, which preferably is monolithic, that attaches to a drill bit body with a central longitudinal axis so as to form a rotary drill bit. The hard member has a forward surface and a rearward surface. At least three discrete leading cutting edges project from the forward surface of the hard member. Each cutting edge is not straight but has an irregular non-linear shape. In one embodiment the leading cutting edge is stepped. It is believed that the stepped cutting edge provides for disintegration of earth strata into smaller sized particles than a straight cutting edge.

In a form of the invention is a roof drill bit body for attachment to a hard member so as to form a rotary drill bit for penetrating earth strata that generates debris wherein the drill bit body comprises a central bore, and a peripheral surface. The peripheral surface contains a trio of debris apertures wherein each aperture is in communication with the central bore.

BRIEF DESCRIPTION OF THE DRAWINGS

The following is a brief description of the drawings that form a part of this patent application.

DETAILED DESCRIPTION OF THE INVENTION

Figure 1:
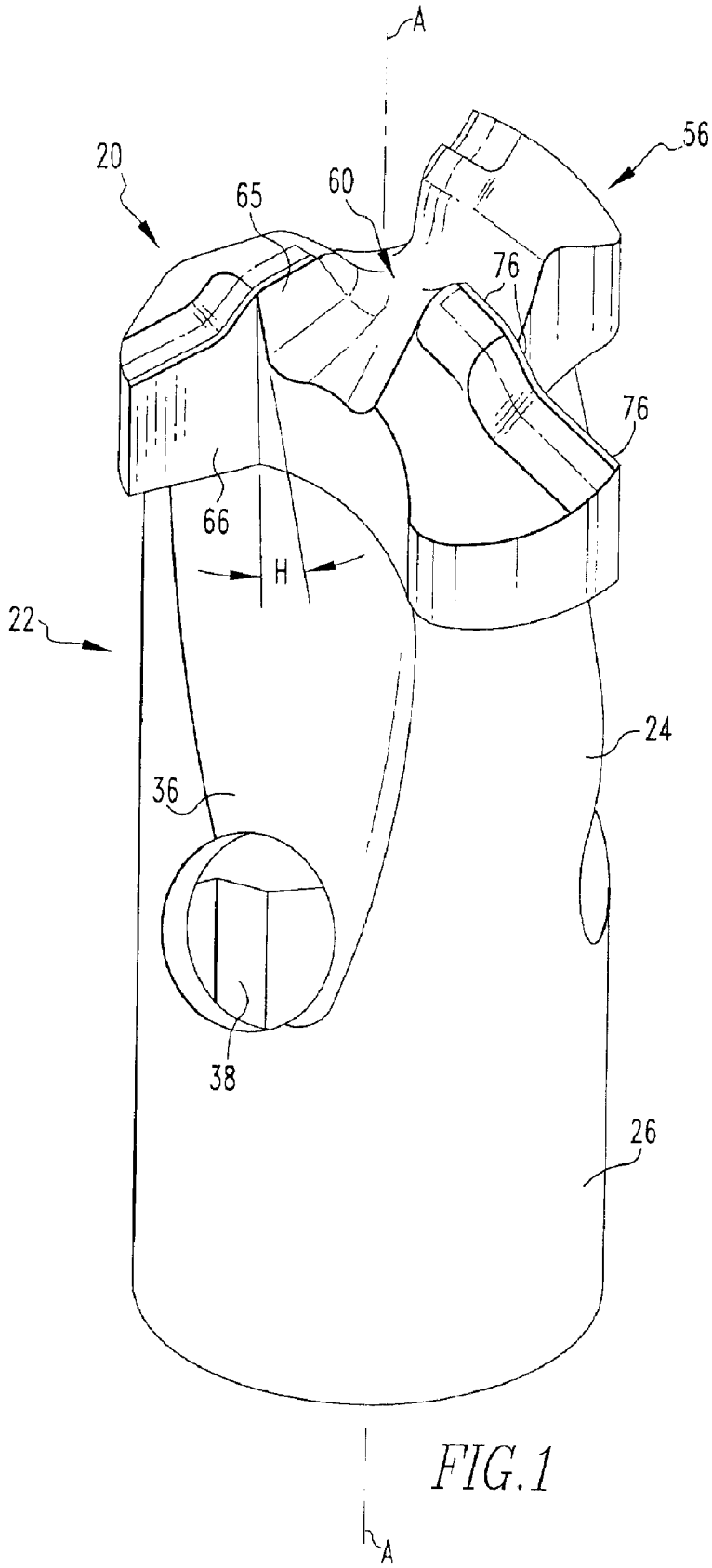
FIG. 1 is an perspective view of a specific embodiment of a roof drill.

Referring to the drawings, there is a roof drill bit generally designated as 20 with a central longitudinal axis A—A. Roof drill bit 20 includes a generally cylindrical elongate steel drill bit body 22 having a diameter equal to 1 inch (2.54 cm). Bit body 22 further includes an axial forward end 24, an axial rearward end 26, the axial rearward end has a generally cylindrical peripheral surface.

There is a pedestal portion at the axial forward end 24. Pedestal portion includes a trio of symmetric arcuate dished-out scalloped surfaces that become narrower (not shown), as well as shallower, as they move in an axial rearward direction. Debris ports 38 permit evacuation of the drilling debris, including larger size pieces of debris, under the influence of a vacuum in dry drilling. The roof drill bit is also useful for wet drilling.

There is a braze joint between the surface of the drill bit body at the axial forward end thereof and the rearward surface of the hard insert. The pedestal portion near its axial forward end either includes a trio of dished out pedestal lobes or a pedestal projection having a trio of symmetric lobes for cooperating respectively with corresponding three prong lobe projections 62 or, alternatively, three dished out lobes for forming a connection between the insert 56 and bit body 22. U.S. patent application Ser. No. 09/591,664, filed Jun. 9, 2000, to Curnie A. Dunn et al. (Case No. K-1554P) is herein incorporated by reference in its entirety.

The roof drill bit hard insert 56 further presents three discrete leading cutting edges 76. However, there may be more than three discrete leading cutting edges depending upon the application.

The hard insert 56 is preferably (but not necessarily) a single monolithic member formed by powder metallurgical techniques from a hard material such a cemented (e.g., cobalt) tungsten carbide alloy wherein a powder mixture is pressed into a green compact and then sintered to form a substantially fully dense part. Applicants contemplate that the hard insert also could be made by injection molding techniques. The preferred grade of cemented tungsten carbide for the hard insert (i.e., Grade 1) contains 6.0 weight percent cobalt (the balance essentially tungsten carbide), and has a tungsten carbide grain size of 1–8 micrometers and a Rockwell A hardness of about 89.9.

Hard insert 56 has a top surface with a central surface area 60 surrounding the central axis A—A (see FIG. 1) and a bottom surface having three prongs projecting therefrom 62. Hard insert 56 has a trio of symmetric lobes 64 wherein each lobe 64 has an upper step portion 80, a transition portion 82 and a lower step portion 84.

Figure 5:
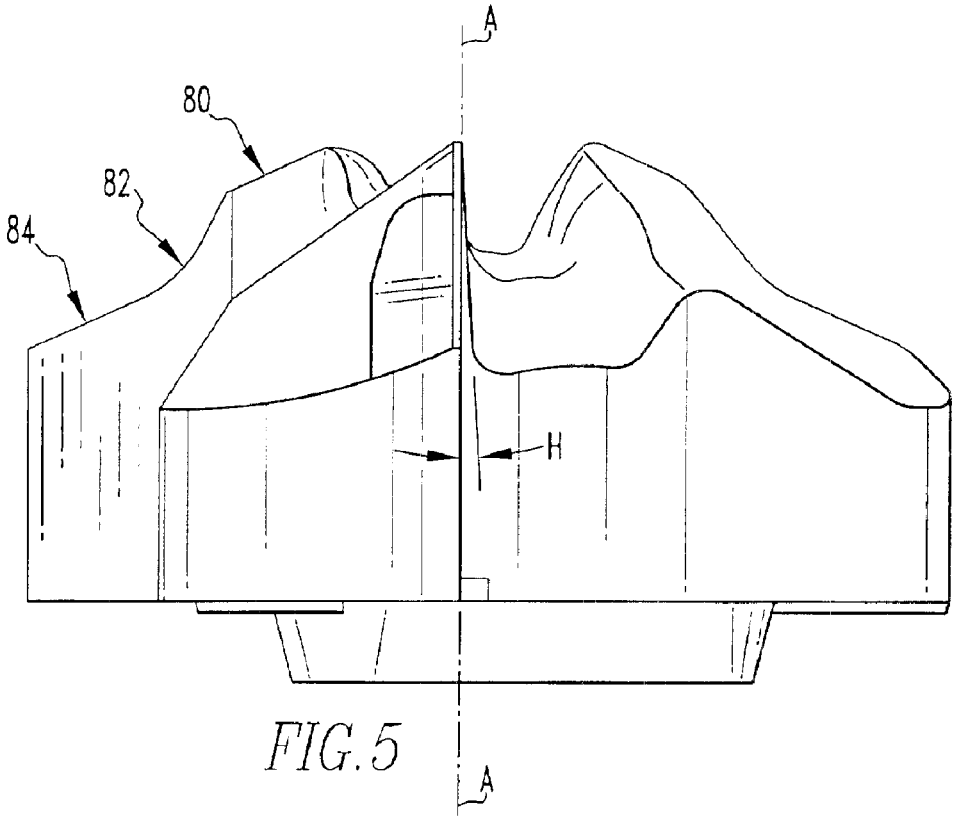
FIG. 5 is a side view of roof drill bit hard insert shown in FIGS. 1–3.

When the hard insert 56 is affixed to the drill bit body 22, the lower leading surface 66 of each lobe 64 is disposed at a rake angle between about zero (0) and negative ten (10) degrees. The rake angle illustrated in the drawings for the lower leading surface is zero (perpendicular to horizontal) degrees. The rake angle "H" for the upper leading surface may range from about zero to about negative fifteen degrees, and more preferably range from about negative five degrees to about negative fifteen degrees. The rake angle in the embodiment illustrated is negative five (5) degrees as best illustrated in FIG. 5. By exhibiting a negative rake angle, applicants provide a hard insert with a strong leading cutting edge. The negative rake angle also provides for better powder flow during the fabrication process so as to enhance the overall integrity (including uniform density) of the hard insert.

The upper step portion has a generally planar relief top surface 86 at a constant angle of approximately thirty (30) degrees along its entire length. The lower step portion has a generally planar relief top surface 90 oriented at a constant relief angle of approximately twenty-one (21) degrees. The transition portion has a generally planar top surface 88 oriented at a constant relief angle of approximately eighteen 18 degrees. The upper relief angle can range between 15–40 degrees, the transition relief angle between 5–30 degrees and the lower relief angle between 5–30 degrees as may be determined adequate by an ordinary artisan. The proper relief angles required to maintain speed and performance are well-known to be related to the cutting operation and earth strata being penetrated. The cutting edge 76 has a chamfer 92 as are commonly used in the art along the top surface thereof to reduce chipping of the cutting edge.

Figure 4:
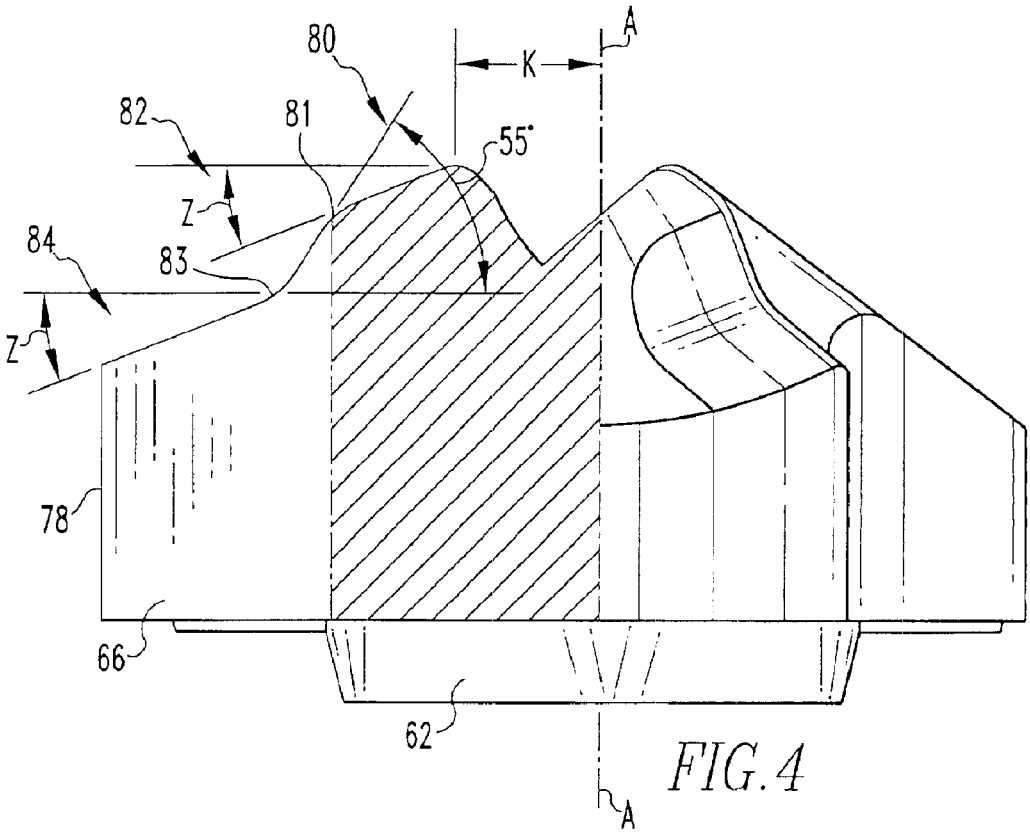
FIG. 4 is a partial cross section of a view of the hard insert taken along lines 4—4 in FIG. 3.

Each lobe 64 further includes a distal peripheral surface 74. The lower leading surface 66 intersects the distal peripheral surface 74 to form a generally straight side clearance cutting edge 78 at the intersection thereof. The rake surfaces 66 and 65 intersect the top surface of a lobe so as to form a stepped leading cutting edge 76 at the intersection thereof. An upper step of the leading cutting edge is connected to a lower step by a transition section. The upper step and lower step are formed along parallel lines, the leading cutting edges are both disposed at the same downward angle Z with respect to the horizontal as shown in FIG. 4. Angle Z makes an angle between 5–35 degrees with respect to the horizontal. The angle Z illustrated in FIG. 4 is 20 degrees. A transition cutting edge forms the transition between the upper step and lowers step cutting edge. The transition cutting edge is inclined at an angle of between 35–75 degrees. In FIG. 4 the transition edge is oriented at 55 degrees with respect to the horizontal.

A central section of the transition portion has a cutting edge 76 that is generally straight at said central section and has two rounded portions at both ends of the central straight edge section. As best seen in FIG. 4 a rounded concave cutting edge section 83 forms a smooth transition between the lower step 84 and the transition section 82 and a rounded convex cutting edge section 81 forms a smooth transition between the transition section 82 and upper step portion 80. The rounded concave section 83 and rounded convex section 81 have a radius of curvature of between 0.03 and 0.12 inches, a radius of 0.06 inches for both the concave 83 and convex 81 sections works effectively for a cutting edge used in earth material of general hardness and composition.

It is believed that the stepped cutting edge improves the disintegration of materials into smaller cuttings in comparison to a straight line leading cutting edge as disclosed in U.S. patent application Ser. No. 09/591,644. The smaller cuttings result in less plugging of the central vacuum line. When a bit body identical to the instant application is substituted for a prior art monolithic 3-blade insert, such as disclosed in Ser. No. 09/591,644, the roof bit drill employing an insert according to the instant application can be run at full throttle whereas with the roof bit in Ser. No. 09/591,644 it might occasionally be required to back off the throttle (also known as "feathered").

Referring back to the geometry of the upper step leading cutting edge and lower step leading cutting edge and side cutting edge, while the upper and lower sections cutting edges and side cutting edge are generally straight and the leading cutting edge relief top surfaces planar and perform in an acceptable fashion, other cutting edge geometries are acceptable for use. For example, the following patent documents disclose suitable cutting edge geometries: U.S. Pat. No. 4,787,464 to Ojanen, U.S. Pat. No. 5,172,775 to Sheirer et al., U.S. Pat. No. 5,184,689 to Sheirer et al., U.S. Pat. No. 5,429,199 to Sheirer et al., and U.S. Pat. No. 5,467,837 to Miller et al. Each one of the above patents is hereby incorporated by reference herein.

Figure 2:
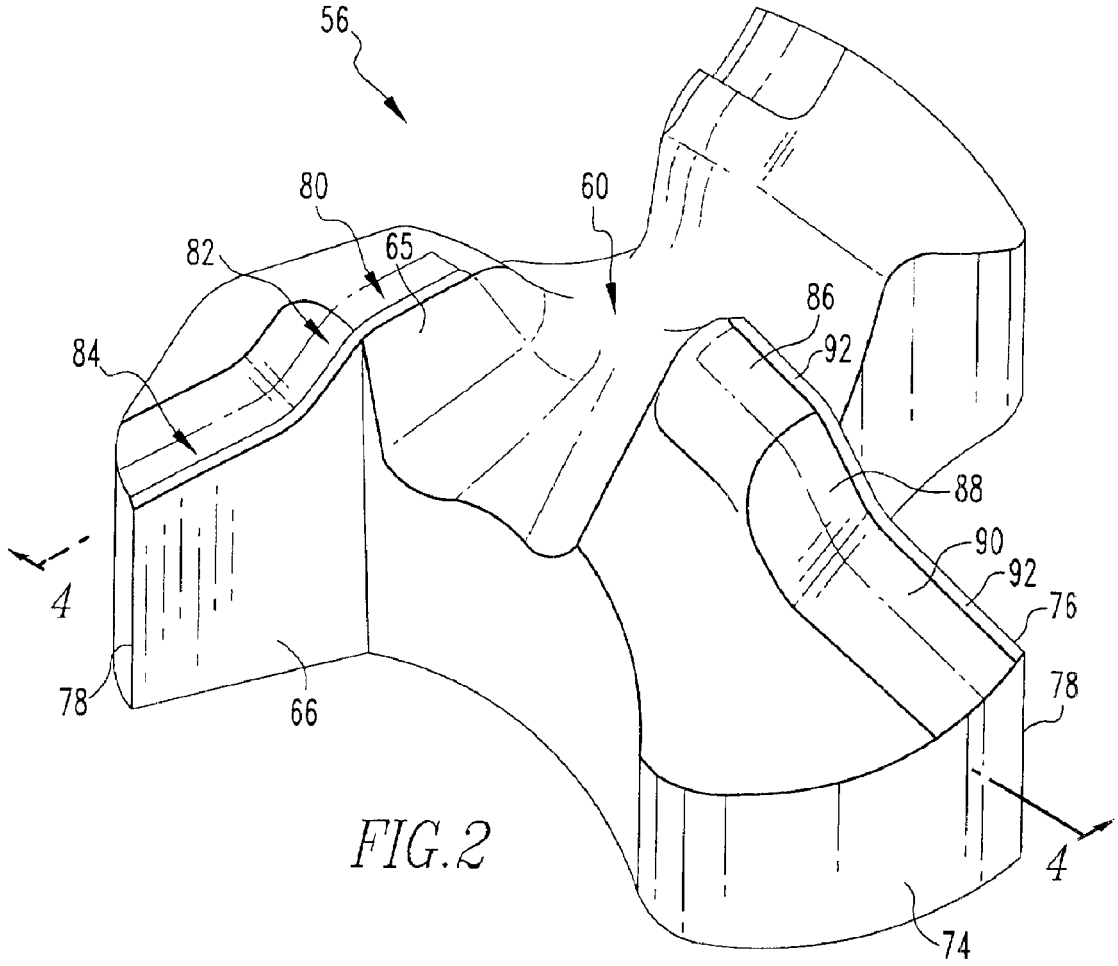
FIG. 2 is an isometric view of the hard insert of FIG. 1.
Figure 3:
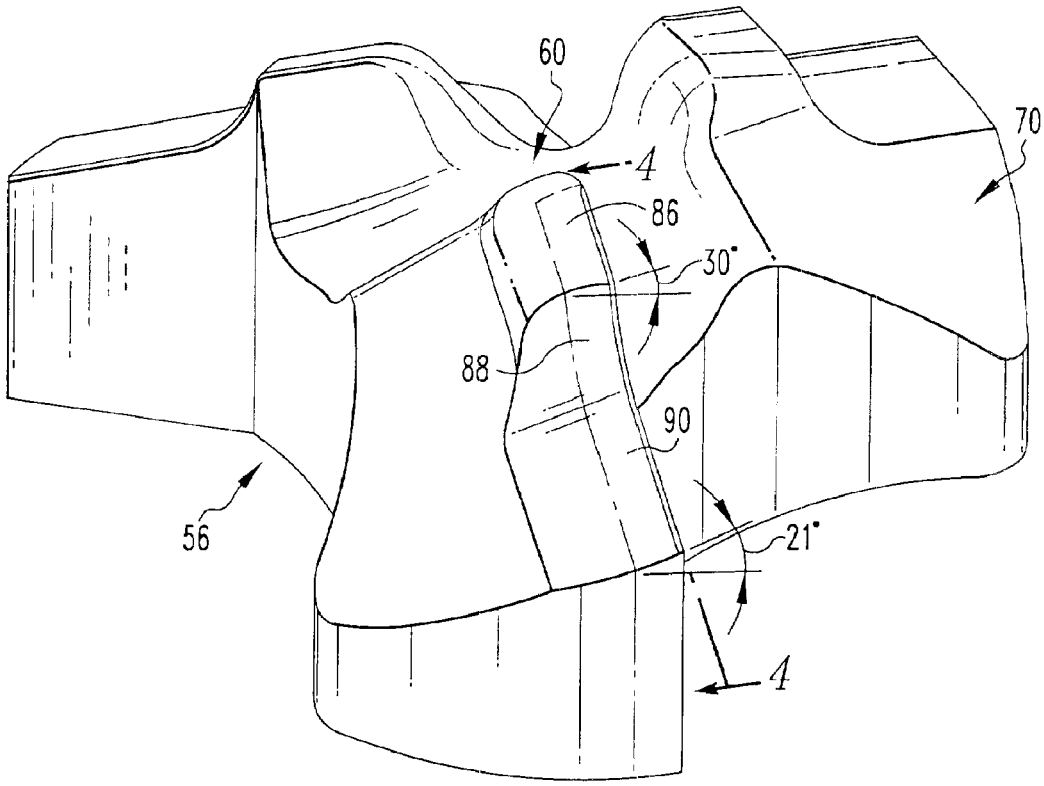
FIG. 3 is a perspective view of the hard insert of FIG. 1 in a second position.

Referring to FIG. 2, the leading cutting edges 76 of the hard insert 56 have a generally radial orientation. A line laying along each leading cutting edge when extended in a radial inward direction passes through central longitudinal axis A—A of the roof drill bit 20.

Each one of the leading cutting edges 76 begins at a point that is a distance radially outward from the central axis of the hard insert 56. The distance K is typically between 1/16–3/16 inches and in a preferred embodiment for earth strata of typical hardness is 1/8 inches form the central axis. Each leading cutting edge 76 has an upper step that extends in a radial outward direction to a transition portion. The upper step has a cutting edge length of between 1/8–1/4 inch. The upper step cutting edge preferably being approximately 1/8 inches in length so as to generate acceptable size cuttings when drilling typical earth strata. For other types of earth strata being drilled the upper step cutting edge accordingly might have a length of about 1/4 inch so as to disintegrate the material into adequately small sizes to enter into dust openings 38.

The transition portion rises a vertical height of generally between 1/16–1/8 inches from the lower step to the upper step. For earth strata of normal hardness the change in height is preferably about 0.06 inches. The vertical distance separating the upper and lower step and the length of the upper step cutting edge are critical design dimensions that influence the size of the cuttings.

There is an open central area 60 (see FIG. 2) surrounding the central axis A—A of the hard insert. The portion of each leading cutting edge nearer the central axis A—A travels a shorter distance per revolution than does the distal portion of each leading cutting edge. Because each leading cutting edge 76 does not extend to the central axis of the hard insert 56 there is a reduction in the amount of low velocity cutting, i.e., cutting that occurs at or near the center point of the hard insert. Generally speaking, a reduction in the amount of low velocity cutting increases the penetration rate of a roof drill bit so that (all other things being equal) an increase in the magnitude of distance "K" (FIG. 4) may increase the penetration rate.

In operation, the roof drill bit 20 rotates and impinges against the earth strata so that the leading cutting edges 76 contact the earth strata so as to cut a borehole and the side clearance cutting edges 78 cut the side clearance for the borehole. Although optimum parameters depend upon the specific circumstance, typical rotational speeds range between about 450 to about 650 revolutions per minute (rpm) and typical thrusts range between about 1000 and 3000 pounds.

The drilling operation generates debris and dust particles. The debris needs to be handled and removed from the borehole so as to not interfere with the drilling operation. In roof drill bit 20, the debris smoothly moves over the lower leading rake surfaces 66 and upper leading rake surfaces 65 of each one of the lobes 64 and directly into the corresponding debris port 38. By providing a trio of debris ports, the roof drill bit 20 provides a way for the debris to quickly and efficiently be removed from the vicinity of the drilling. The removal of debris, and especially larger size debris, is enhanced by the configuration of the scalloped portion 36 and the offset and axial location of the debris port. The consequence is that the debris generated by the drilling (and especially larger-sized debris) does not interfere with the efficiency of the overall drilling operation.

Because these three discrete leading cutting edges 76 have a generally radial orientation, the roof drill bit 20 exhibits excellent balance so as to continue to steadily advance with little, and possibly no, wobble, i.e., side-to-side movement. While the generally radial orientation of the leading cutting edges appears to provide the above-described advantage, applicants would expect that the roof drill bit would still exhibit improved performance even if the hard insert would have leading cutting edges that would not have a generally radial orientation.

In other alternative embodiments the bit body has a breaker along the scalloped sections 36 such as illustrated in FIGS. 5–8 of U.S. patent application Ser. No. 09/591,644 can be employed to further help disintegrate the cutting.

In another embodiment the lobed drill bit insert 56 is identical in shape and size to the embodiment illustrated in FIGS. 1–5 but in the alternative embodiment each lobe instead of being monolithic is a composite of substrates similar to the embodiment shown in FIG. 9 of U.S. patent application Ser. No. 09/591,664 which is incorporated by reference herein. Small cutting elements including the cutting surface and edge are made from a separate material having a hardness greater than both the bit body and the material that the remainder of the drill bit insert 56 is constructed from. The small cutting elements are received in sockets formed in a bit insert body and brazed therein. Such sockets and integration of separate substrates into an integral body are well-known in industry. To construct a socket and a two stepped cutting element for each lobe of applicants' invention would fall within the realm of the capabilities of an ordinary artisan.

The patents and other documents identified herein are hereby incorporated by reference herein.

Other embodiments of the invention will be apparent to those skilled in the art from a consideration of the specification (including the drawings) or practice of the invention disclosed herein. It is intended that the specification and examples be considered as illustrative only, with the true scope and spirit of the invention being indicated by the following claims.

What is claimed is:

1. A rotary drill bit for penetrating earth strata, the drill bit comprising: an elongate bit body having an axial forward end; and a monolithic hard insert being affixed to the bit body at the axial forward end thereof, said hard insert having a trio of symmetric lobes, each said lobe having a discrete stepped leading cutting edge, each said stepped leading cutting edge having a straight upper step, a transition portion connected to said upper step and a straight lower step connected to said transition portion, said upper step of said leading cutting edge having an upper leading surface, said upper leading surface disposed at a rake angle with the vertical of between about five degrees to about negative fifteen degrees, said lower step and said transition portion of said leading cutting edge having a lower leading surface disposed at a rake angle with the vertical of between about zero degrees to about negative ten degrees.

2. The rotary drill bit of claim 1 wherein said upper step and said lower step on each leading cutting edge are parallel.

3. The rotary drill bit of claim 2 wherein said lower step and said upper step on each said leading cutting edge are oriented at an angle of about 5 to 35 degrees with respect to the horizontal.

4. The rotary drill bit of claim 1 wherein said cutting edge transition portion positioned between said lower step and said upper step rises a vertical height of generally between 1/16–1/8 inches.

5. The rotary drill bit of claim 1 wherein the rotary drill bit has a central longitudinal axis passing through the hard insert, the bit body having a peripheral surface, and each one of the leading cutting edges for cutting the earth strata begins at a point radially outward of the central axis of the hard insert and extends in a direction away from the central axis.

6. The rotary drill bit of claim 5 wherein each of said stepped leading cutting edges has a radially inward upper step and a radially outward lower step.

7. The rotary drill bit of claim 6 wherein each of said upper steps have a length of generally between 1/8–1/4 inches.

8. The rotary drill bit of claim 1 wherein said upper step of each said leading cutting edge has a top surface relief angle of about 15 to 40 degrees, said transition portion of each said leading cutting edge has a top surface relief angle of 5 to 30 degrees and said lower step of each said leading cutting edge has a top surface relief angle of about 5 to 30 degrees.

9. The hard insert of claim 1 wherein each said lobe has a side clearance cutting edge corresponding to each one of said leading cutting edges.

* * * * *